US005778295A

United States Patent [19]

Chen et al.

[11] Patent Number: 5,778,295

[45] Date of Patent: Jul. 7, 1998

[54] TONER FUSING BELT AND METHOD OF USING SAME

[75] Inventors: Jiann H. Chen, Fairport; Muhammed Aslam, Rochester; Wayne T. Ferrar, Fairport; Andy H. Tsou, Pittsford, all of N.Y.

[73] Assignee: Eastman Kodak Company, Rochester, N.Y.

[21] Appl. No.: 812,370

[22] Filed: Mar. 5, 1997

[51] Int. Cl.[6] ..... G03G 15/20

[52] U.S. Cl. ..... 399/329; 428/448

[58] Field of Search ..... 399/329; 219/216; 430/124; 428/446–448, 473.5

[56] References Cited

U.S. PATENT DOCUMENTS 4,027,073 5/1977 Clark .
4,439,509 3/1984 Schank .
4,595,602 6/1986 Schank .
4,923,775 5/1990 Schank .
5,089,363 2/1992 Rimai et al. ..... 430/45
5,153,656 10/1992 Johnson et al. ..... 399/303
5,309,210 5/1994 Yamamoto et al. ..... 399/329
5,411,779 5/1995 Nakajima et al. .
5,532,056 7/1996 Satoh et al. ..... 428/332
5,641,568 6/1997 Satoh et al. ..... 428/332
5,708,948 1/1998 Chen et al. ..... 399/329

*Primary Examiner*—Robert Beatty
*Attorney, Agent, or Firm*—Doreen M. Wells

[57] ABSTRACT

A fusing belt for thermoplastic electrostatographic toner comprises a seamless polyimide resin belt having an intermediate layer of a highly crosslinked silicone resin, which preferably contains a surfactant, and a surface layer of a silsesquioxane polymer, which also preferably contains a surfactant. The belt produces fused toner images of high gloss and has good release properties without the use of a release oil.

11 Claims, 1 Drawing Sheet

TONER FUSING BELT AND METHOD OF USING SAME

RELATED APPLICATIONS

Copending U.S. patent applications Ser. No. 08/691,621, filed Aug. 2, 1996, now U.S. Pat. No. 5,708,948 entitled "Fuser Belts with Improved Release and Gloss" and Ser. No. 08/667,270, filed Jul. 20, 1996, now U.S. Pat. No. 5,731,117, entitled "Overcoated Charge Transporting Elements and Glassy Solid Electrolytes" are related applications.

FIELD OF THE INVENTION

This invention relates to the fusing of electrostatographic toner particles and, more particularly, to a novel fusing belt and method for the fusing and fixing of electrostatographic toners to receiver sheets.

BACKGROUND OF THE INVENTION

The fusing of thermoplastic dry toner powders to receiver sheets of paper or plastic to form electrostatographic images or copies is well known in electrophotographic and dielectric recording processes. Either black and white or multicolor images can be formed by fusing such thermoplastic toners to receiver sheets. Two types of fuser systems have been used for applying heat and pressure to fuse and fix the toner particles to the receiver, namely, fuser roller systems and fuser belt systems. A problem with fuser roller systems has been that the release temperature of the rollers, that is, the temperature at which the receiver sheet leaves the nip of the rollers, is high. The toner then acts as a hot melt adhesive and can cause the receiver sheet to adhere to the roller. One way to improve the release of the toner and receiver from the fuser roller is to apply a silicone release oil to the roller. Release oils have, however, several disadvantages. Some of the release oil can remain with the fused image sheet and give the sheet an oily feel. It is also difficult to write on a sheet that has release oil on its surface and, when the sheet is handled, fingerprints are readily seen. Release oils also can coat the inside of the electrostatographic machine and may affect the machine reliability. Further, the mechanical complexity of the oil delivery system affects the reliability of the machine.

To avoid the use of release oils, it is known to add low molecular weight polyolefins or functionalized fatty waxes to toner compositions to improve the release of toner from fuser rollers. These additives help provide release from the roller surface if the roller has low surface energy. The low molecular weight polyolefins or functionalized fatty waxes, however, tend to coat the surface of the fuser roller, leading to roller failure. It is also difficult with fuser rollers to form images having high gloss.

Fuser belt systems can reduce some of the problems encountered with fuser rollers. For example, U.S. Pat. No. 5,089,363 discloses that metal belts coated with highly cross-linked polysiloxanes produce toner images having high gloss. Such polymeric release coatings, however, have poor adhesion to the usual belt substrate materials. Also, the coatings wear rapidly when they contact an abrasive surface such as bond paper or uncoated laser print paper under heat and pressure for repeated cycles. There is a need for a fuser belt that can form a fused toner image of high gloss and that is durable and releases toner images well without a silicone or other type of release oil.

BRIEF SUMMARY OF THE INVENTION

The present invention provides an improved means for fusing and fixing thermoplastic toners, and a method of making such fusing means. The fusing means of the invention, which avoids or reduces the problems mentioned above, comprises a fusing belt that comprises: a seamless polyimide substrate; a cross-linked silicone resin intermediate layer that is formed by curing a plasticized composition comprising siloxanes having a ratio of difunctional to trifunctional units of 1:1 to 1:2.7, at least 90% of the total number of functional units of the siloxanes being difunctional and trifunctional units, the cross-linked silicone resin having a weight average molecular weight of 5,000 to 50,000, and an alkyl to aryl ratio of 1:0.1 to 1:1.2; and, coated on the intermediate layer, a surface layer that comprises a silsesquioxane polymer. The invention also includes the method of fusing thermoplastic toners to a receiver with the novel fusing belt without the use of a release oil and forming fused images of high gloss, namely, a gloss value measured at 20° of at least 90.

In the method of the invention, a receiver sheet bearing unfused thermoplastic toner is passed through the nip of a belt fuser apparatus in contact with the silisesquioxane surface layer of a fusing belt of the invention, thereby fusing the toner on the receiver and forming a fused toner image. The moving belt is cooled, and the receiver sheet is separated from the cooled belt to obtain a sheet bearing a fused toner image having a 20° gloss of at least 90. The novel method also includes fusing the toner and separating the receiver sheet from the belt without the use of a release oil.

THE DRAWINGS

Figure 1:
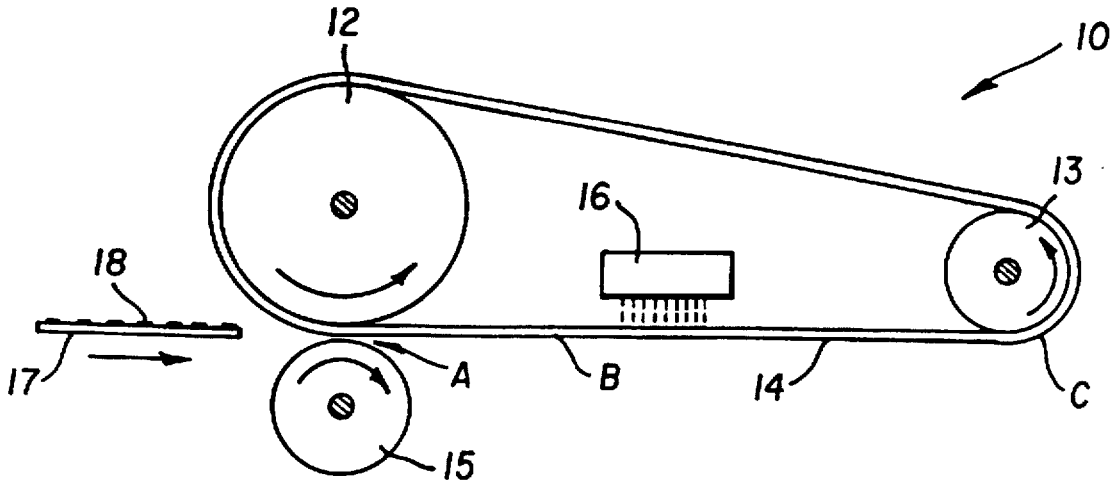
FIG. 1 is a schematic illustration of a toner fusing apparatus in which the fusing belt of the invention can be used.
Figure 2:
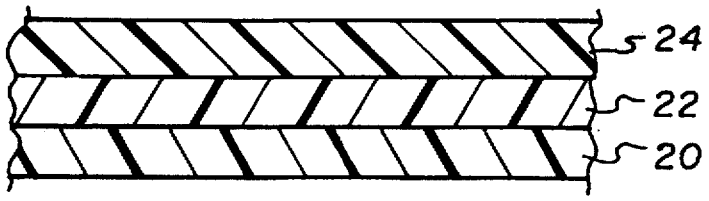
FIG. 2 is a cross-sectional view of the belt described in the disclosure and claims wherein 20 represents a polyimide substrate belt; 22 represents a silicone resin intermediate layer; and 24 represents a surface layer.

The sole figure of the drawing, FIG. 1, is a schematic illustration of a toner fusing apparatus in which the fusing belt of the invention can be used.

DETAILED DESCRIPTION

The fuser belt of the invention can be of any size and can be used in any kind of fuser belt system. For example, the fuser belt system can comprise a fuser belt that is trained around two or more rollers, and is in pressure contact with another belt or a roller. FIG. 1 illustrates one suitable configuration for a fuser belt apparatus 10 having a fuser belt 14 of the invention, with which the method of the invention can be practiced. The apparatus 10 includes a heating roller 12 and an unheated roller 13 around which belt 14 is trained and is conveyed in the direction indicated by arrows on rollers 12 and 13. Backup roller 15 presses against the belt and the heating roller 12. The fuser belt 14 is cooled by impinging air from blower 16 positioned above belt 14. In operation, a receiver sheet 17 of paper or plastic bearing unfused thermoplastic toner powder 18 is moved in the direction of the arrow through the nip between heating roller 12 and backup roller 15, which can optionally also be heated and enters a fusing zone A extending about 0.25 to 2.5 cm, preferably about 0.6 cm, laterally along the fuser belt 14. After the toner is fused in zone A, the sheet 17 continues along the path of the moving belt 14 and into the cooling zone B, extending 5 to 50 cm in the region from zone A to roller 13. In cooling zone B, belt 14 is cooled slightly upon leaving heating roller 12 and then is further cooled in a controlled manner by air that impinges upon the belt from blower 16. Sheet 17 separates from belt 14 as the belt passes around roller 13 and is transported to a copy collection means such as a tray (not shown). Sheet 17 is separated from belt 14 within the release zone C at a relatively low temperature at which no toner offset onto the belt occurs.

In accordance with the present invention, the fuser belt 14 is a seamless polyimide belt having a novel combination of coatings which will be described hereinafter. An important advantage of a polyimide as a substrate for the coated belt is that it can be fabricated as a seamless belt, thus avoiding the disadvantage of belts having seams, in that the seams become visible in the toner image.

Other advantages of a polyimide fusing belt over other belts include the fact that a polyimide belt cools more rapidly than a metal belt after it leaves the heated nip of the fuser system, e.g., zone A in the apparatus shown in FIG. 1.

A polyimide belt is also highly flexible and can be more easily handled without forming kinks than a metal belt. A polyimide belt also adheres well to silicone resin coatings and is less subject to delamination than other belt materials. In general, therefore, a polyimide belt is less subject to image defects than fusing belts of other materials.

Polyimides useful as fusing belts are disclosed in U.S. Pat. No. 5,411,779, dated May 2, 1995, which is incorporated herein by reference. As disclosed in the cited patent, the polyimide can be prepared in tubular or belt form by coating a poly(amic acid) solution on the inner circumference of a cylinder and imidizing the poly(amic acid) to form a tubular inner layer of the polyimide resin. The poly(amic acid) can be obtained by reacting a tetracarboxylic dianhydride or derivative thereof with an approximately equimolar amount of a diamine in an organic polar solvent. Examples of tetracarboxylic dianhydrides, diamines, solvents and reaction procedures are disclosed in the cited patent, especially in columns 4–6 and in the numbered examples.

Although polyimide belts have the advantages mentioned above, an uncoated polyimide belt has less than optimum release qualities for fused thermoplastic toners. A need exists for a coating that releases well from fused thermoplastic toner and that adheres well to a polyimide belt under the stress of repeated heating, cooling and flexing. The present invention provides such a coating, not in a single layer, but in a novel combination of layers of materials.

In the fusing belt of the invention, the polyimide substrate is coated with a cross-linked silicone resin, in particular, a resin that is formed by curing a composition comprising siloxanes having a ratio of difunctional to trifunctional units of 1:1 to 1:2.7, at least 90% of the total number of functional units of said siloxanes being difunctional and trifunctional units, and having a weight average molecular weight of 5,000 to 50,000 and an alkyl to aryl ratio of 1:0.1 to 1:1.2. The present inventors have found that this type of cross-linked silicone resin adheres well to a polyimide resin belt and also to a polymer they found to have excellent qualities as a toner release surface coating but poor adhesion to the polyimide. Thus, the described highly cross-linked silicone resin serves as an unexpectedly superior adhesive or priming coat for the desirable surface coating.

The highly cross-linked silicone resin that forms the adhesive or intermediate layer between the polyimide belt and the surface layer in the fusing belt of the invention is described in detail in U.S. Pat. No. 5,708,948 of Chen et al., filed Aug. 2, 1996. This application, which is incorporated herein by reference, discloses the use of the silicone resin as a release layer for a fuser belt formed of metal or other materials. The present invention provides a further improvement in fusing belts wherein the highly cross-linked silicone resin provides adhesion to a polyimide belt for a surface layer that has exceptionally good release and wear properties and is capable of forming toned images of high gloss.

The silicone resin of the coating on the substrate can comprise monofunctional, difunctional, trifunctional, and tetrafunctional units (as these terms are used in the well known General Electric notation), or units having mixtures of these functionalities. Monofunctional units can be represented by the formula—$(R)_3SiO_{0.5}$—Difunctional units can be represented by the formula—$(R)_2SiO$—. Trifunctional units can be represented by the formula—$(R)SiO_{1.5}$—. Tetrafunctional units can be represented by the formula—$SiO_2$—. R in the formulas independently represents alkyl groups preferably having from 1 to 8 carbons, more preferably, 1 to 5 carbons, or aryl groups preferably having 6 to 10 carbons in the ring(s), more preferably, 6 carbons in the ring(s). The siloxanes used to form the silicone resin comprise at least some R groups that are alkyl groups, and some R groups that are aryl groups. Mixtures of different alkyl groups and different aryl groups may be present in the siloxanes. The alkyl and aryl groups can comprise additional substituents and heteroatoms such as halogens in, for example, a fluoropropyl group, and alkyl groups in, for example, a methylphenyl group. The alkyl groups are preferably methyl, ethyl, propyl, isopropyl, butyl, isobutyl, tert-butyl, pentyl, more preferably methyl, ethyl, propyl, and isopropyl, most preferably methyl. The aryl groups are preferably phenyl, diphenyl, or benzyl, more preferably phenyl. The silicone resins have an alkyl to aryl ratio of 1:0.1 to 1:1.2; more preferably 1:0.3 to 1:1.0; and most preferably 1:0.4 to 1:0.9. The silicone resin has a ratio of difunctional to trifunctional units of 1:1 to 1:2.7, more preferably 1:1.5 to 1:2.5, most preferably 1:1.8 to 1:2.3; at least 90% of the total number of functional units in the silicone resin are difunctional and trifunctional units. More preferably, at least 95% of the total number of functional units in the silicone resin are difunctional and trifunctional units and, most preferably, at least 98% of total number of functional units in the silicone resin are difunctional and trifunctional units. The preferred silicone resins comprise substantially only difunctional, trifunctional and tetra-functional units, meaning that the preferred silicone resins comprise less than 1% mono-functional units of the total number of functional units in the silicone resin. The most preferred silicone resins comprise substantially only difunctional and trifunctional units, meaning that the most preferred silicone resins comprise less than 1% monofunctional and tetrafunctional units of the total number of functional units in the silicone resin. The percentages of the functionalities in the silicone resin can be determined using $Si^{29}$ NMR.

The silicone resin is made by curing a composition comprising siloxanes. Siloxanes can be monofunctional, difunctional, trifunctional, and/or tetrafunctional silicone polymers. The siloxanes are preferably hydroxy-terminated silicone polymers or have at least two hydroxy groups per siloxane. The weightaverage molecular weight of the siloxanes used to make the thermoset silicone resin is preferably 5,000 to 50,000 grams/mole (g/mol). Even more preferred are siloxanes having a weight-average molecular weight of 7,500 to 10,000 g/mol, and more preferably 7,500 to 8,500. The weight-average molecular weight is determined by Size Exclusion Chromatography (SEC). Once the silicone resin is cured, typically by thermosetting, it is difficult to determine the weight- average molecular weight of the siloxanes used to form the silicone resin; however, the functional units and alkyl to aryl ratio of the siloxanes will be the same for the silicone resin and the siloxanes used to make the silicone resin.

The silicone resin can be prepared as described in numerous publications. Such silicone resins are hard, brittle, and highly cross-linked, as compared to silicone elastomers, which are deformable and elastic. One method to form the silicone resin is by a condensation reaction as described in, for example, D. Sats, *Handbook of Pressure Sensitive Adhesive Technology*, 2nd Ed., pp. 601–609, Van Nostrand Reinhold (1989). Other references that disclose the preparation of these highly cross-linked silicone resins are Kirk-Othmer, *Encyclopedia of Chemical Technology*, 3rd Ed., Vol. 20, pp. 940–962; and Lichtenwalter and Sprung, Bikales, Ed., *Encyclopedia of Polymer Science and Technology*, Vol. 12, Inter-science Publishers, (NY 1970) pg. 464. Useful silicone resins are commercially available, for example, DM 30036 and DM 30020, from Acheson Colloids Company, and DC-2531, from Dow Corning.

Although the described cross-linked silicone resin has excellent properties as an adhesive layer between the polyimide substrate and the silsesquioxane surface layer of the fusing belt, the present inventors have found that the highly crosslinked silicone resin is brittle and may crack when the fusing belt is flexed repeatedly. In accordance with the invention, therefore, a surfactant plasticizer is incorporated in the silicone composition before it is coated and cured on the polyimide substrate. In general, compounds known for use as surfactants in silicone coating compositions, can serve as plasticizers and coating aids or surfactants for the silicone composition that is coated on the polyimide belt and thereafter cured. Examples of commercially available compounds of this kind include the compound available from Geleste Corporation as DMS-C25 surfactant, which is a polyethylene oxide-polydimethyl siloxane copolymer. More particularly, such preferred surfactants can be described as polyethylene oxide end-capped polydimethylsiloxanes having terminal hydroxy groups. Other classes of suitable surfactants are polydimethylsiloxanes having terminal amino or epoxy groups. The amount of surfactant is preferably in the range from about 1 to 8 percent by weight of the coating composition and, most, preferably is in the range from about 2 to 4 weight percent.

The surface coating or layer for the fusing belt of the invention is a silsesquioxane polymer. It has excellent toner release properties without the use of a release oil, excellent wear properties and can form a toner image of high gloss, namely, a gloss of at least 90 at 20°. Advantageously, the image gloss can be even higher, e.g., more than 95 at 20°, with the fusing belt of the invention. Gloss can be measured using a BYK Gardner Micro Gloss Meter at a setting of 20°, using the procedure of ASTM-523-67. The silsesquioxane does not adhere well to a polyimide belt but, when used in the novel combination of the invention, it adheres well to the highly cross-linked silicone resin that forms the intermediate or adhesive layer between the polyimide substrate and the surface layer.

Silsesquioxanes are a class of inorganic/organic glasses that can be formed at moderate temperatures by a procedure commonly referred to as a "sol-gel" process. In the sol-gel process, silicon alkoxides a solvent, forming the "sol"; then the solvent is removed, resulting in a condensation and the formation of a cross-linked "gel." A variety of solvents can be used. Aqueous, aqueous-alcoholic, and alcoholic solvents are generally preferred. Silsesquioxanes are conveniently coated from acidic alcohols, since the silicic acid form, $RSi(OH)_3$, is quite stable in solution for months under ambient conditions. The extent of condensation is related to the amount of curing a sample receives, temperature and time being among the two most important variables.

Silsesquioxanes can be represented by the formula $(RSiO_{1.5})_n$, where R is an organic group and n is the number of repeating units. Thus, the prefix "sesqui" refers to a one and one-half stoichiometry of oxygen. The polymers can be prepared by the hydrolysis and condensation of trialkoxysilanes. U.S. Pat. No. 4,027,073 to Clark teaches the use of silsesquioxanes as abrasion resistant coatings on organic polymers. Typical applications include scratch resistant coatings on acrylic lenses and transparent glazing materials; the cited patent teaches that a preferred thickness for good scratch resistance is from 2 to 10 micrometers. U.S. Pat. No. 4,439,509 to Schank teaches photoconducting elements for electrophotography that have silsesquioxane coatings having a thickness of 0.5 to 2.0 micrometers. This thickness is purported to optimize electrical, transfer, cleaning and scratch resistance properties. This teaching contrasts with that of U.S. Pat. No. 4,027,073, which teaches that a preferred thickness of a silsesquioxane layer for good scratch resistance is from 2 to 10 micrometers. U.S. Pat. No. 4,923,775 to Shank teaches that methylsilsesquioxane is preferred since it produces the hardest material in comparison to other alkylsilanes. U.S. Pat. No. 4,595,602 to Schank teaches a conductive overcoat of cross-linked "siloxanol-colloidal silica hybrid" having a preferred thickness of from 0.3 to 5.0 micrometers. All of these cited patents are incorporated herein by reference.

The formula $(RSiO_{1.5})_n$ above, which is sometimes written $[Si(O_{1/2})_3R_n]$ is a useful shorthand for silsesquioxanes but, except as to fully cured silsesquioxane, it does not fully characterize the material. This is important, since silsesquioxanes can be utilized in an incompletely cured state. An additional nomenclature, derived from one described in R. H. Glaser, G. L. Wilkes, C. E. Bronnimann; *Journal of Non-Crystalline Solids*, 113 (1989) 73–87; uses the initials M, D, T, and Q to designate silicon atoms bonded to 1, 2, 3, or 4 oxygen atoms, respectively. The designation T is subdivided as follows, to identify the number of bonds to other silicon atoms:

| Structure | Designation |
|---|---|
| 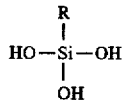 | $T^0$ |
| 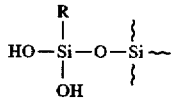 | $T^1$ |
| 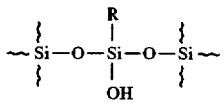 | $T^2$ |
| 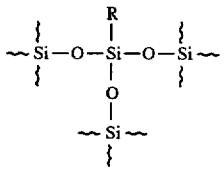 | $T^3$ |

In fully cured silsesquioxanes, substantially all silicons are $T^3$. The extent of curing of the silsesquioxane can be quantified as the ratio of $T^2$ to $T^3$. This ratio is designated herein: "$T^2$-silicon/$T^3$-silicon ratio" or "$T^2/T^3$". The value of $T^2/T^3$ decreases with an increase in cure, and vice versa.

In the silsesquioxanes having the most advantageous properties as a toner fusing belt surface layer in accordance with the invention, the C:Si ratio is greater than about 2:1 and the $T^2/T^3$ ratio is from about 0.5:1 to about 0.1:1. They can be represented by the following structure:

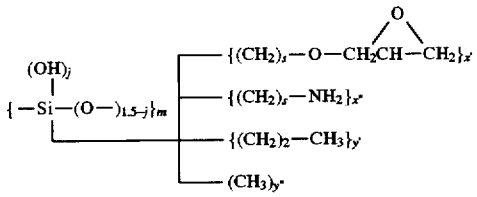

j is from 0 to about 0.5, m is greater than 10;

x' is from about 5 to about 30 mol%;

x" is from about 2 to about 10 mol%;

y' is from about 40 to about 90 mol%; and y" is from 0 to about 55 mol%.

The silsesquioxane is a large oligomer or a polymer. The value of m, that is, the number of subunits for the silsesquioxane is greater than 10. Like highly cross-linked polymers, there is theoretically no upper limit on the number of subunits, and the value of m can be a very large number.

The silsesquioxane surface layer of the fusing belt of the invention preferably contains a surfactant that improves the wetting and adhesion of the surface layer to the intermediate cross-linked silicone layer. In general, surfactants known for use in the coating of aqueous silicone composition can be used. Preferred surfactants are methyl end-capped polydimethylsiloxanes having a polyalkyleneoxide side chain. Especially preferred among commercially available surfactants of this kind are Dow Corning® 190 and 193 surfactants, which are available from Dow Coming Co. and are reported to be silicone glycol copolymers, specifically, dimethylsiloxane-ethylene oxide copolymers, of the formula:

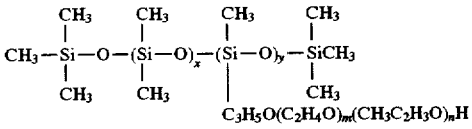

Surfactants of this type comprise, e.g., from 20 to 70 weight percent ethylene oxide repeating units and have viscosities in the range from 400 to 1600 cSt at 25° C.

Another useful surfactant for the silsesquioxane polymer coating is a material marketed by OSi Specialties, Inc., Danbury CT, as Silwet L-7002 lubricant, and reported to be a poly(alkylene oxide)-copoly(dimethylsiloxane). The amount of surfactant in the silsesquioxane coating composition is preferably in the range from about 0.1 to 6 weight percent and most preferably, from about 0.1 to 2 weight percent.

The fuser belt resin coatings can include fillers. It is preferred that the fillers, if present, are in an amount less than 10 wt. %, more preferably less than 7 wt. %, to maintain a smooth surface of the resin on the fuser belt. Examples of useful fillers include alumina, silica, cupric oxide, and stannic oxide. In general, non-filled coatings produce fused toner images of higher gloss than do filled coatings.

Although the fusing belt of the invention can vary considerably in dimensions, the preferred thickness of the flexible polyimide substrate is in the range from about 25 to 250 micrometers. The thickness of the cross-linked silicone intermediate layer on the belt is preferably less than 20 micrometers, and most preferably from 1 to 10 micrometers. The thickness of the silsesquioxane surface layer of the belt is preferably from 1 to 30 micrometers and more preferably from 2 to 15 micrometers. The coatings an be applied in known manner but preferably are applied by ring coating. The intermediate layer is dried and cured by heating before applying the surface layer coating.

EXAMPLES

The preparation of a silsesquioxane polymer useful as a surface layer of a fusing belt of the invention is illustrated by the following example.

Example 1

To a 2 liter Erlenmeyer flask equipped with a magnetic stirrer was added 184.35 g of propyltrimethoxysilane, followed by 61.25 g of methyltrimeth-oxysilane, 61.32 g of 3-glycidoxypropyltrimethoxysilane, and 25.20 g of 3-amino-propyltrimethoxysilane. After stirring for a few minutes, 54.18 g of glacial acetic acid was added dropwise from an addition funnel, and 122.79g of distilled water was added dropwise from an addition funnel. The reaction mixture became exothermic and was cloudy at first but became clear after about half of the water had been added. After completing addition of the water, the flask was covered and the contents stirred overnight. Then 33.8 g of Ludox® silica gel suspension, with pH adjusted from 8.7 to 4.3 by the addition of a few drops of acetic acid, was added dropwise to the reaction flask. The flask was again covered and the contents stirred overnight. Thereafter, 523.25 g of ethanol was added at low flow rate through a funnel to the reaction mixture to obtain a silsesquioxane composition suitable for coating.

The preparation and testing of a fusing belt of the invention are illustrated by the following two examples.

Example 2

A seamless and uncoated polyimide resin belt 823 mm (32.4 inches) in diameter and 254 mm in width (10 inches), manufactured by Gunze Co., was cleaned with anhydrous ethanol and wiped with a lint-free cloth. A mixture of 65.5 g uncured silicone polymer (Acheson RC369, which was filtered before mixing) in 25g of naphtha VMP containing 1.5 g of DMS-C25 surfactant-plasticizer from Geleste Corp. was stirred for 30 minutes. The resulting solution was ring coated on the polyimide belt at a coating speed of 0.072 inch/second, and the coated belt was flashed at room temperature for 20 minutes. The belt was then cured by heating for 40 minutes, including a 10 minute ramp to 150° C. and 30 minutes at 150° C., to form a highly cross-linked silicone resin layer. Thereafter, 100 g of a 20% water-ethanol solution of silsesquioxane sol-gel, prepared substantially as described in Example 1, was mixed for 30 minutes with 0.7 wt.% of DC 190 surfactant. The mixture was then ring coated over the cured silicone coating on the polyimide belt at 0.25 inch/second. The belt was flashed at room temperature for 20 minutes and was cured at 150° C. for 6 hours, including a 4 hour ramp to 150° C. and 2 hours at 150°. In an apparatus substantially as shown in FIG. 1 but having an air knife cooling means operating at 35 psig, the belt was tested without the use of a release oil for the fusing of a black thermoplastic toner powder (Ricoh NC 5006 toner) to sheets of laser print paper at a speed of 1.5 inches per second. The fusing temperature was 250° F., the release temperature was 100° F., and the nip pressure over a distance of 0.240 inches was 35 psig at 240° F. The resulting fused images had a 20° gloss of 98. No sticking or other failure was observed after 6500 copies even though no release oil was used. With a different type of receiver sheet, some toner offset occurred.

Example 3

On a polyimide resin belt, a cured layer of Acheson RC369 silicone polymer containing DMS-C25 surfactant-plasticizer was coated with silsesquioxane sol-gel containing DC 190 surfactant, which was cured by heating, all as described in Example 2. The coated belt was then tested without a release oil in the fusing of Ricoh NC 5006 toner on two kinds of receiver sheets, a "Vintage Velvet" clay-coated paper and a laser print paper. No defects were observed after 10,000 copies on the clay-coated paper. Continuing with the laser print paper, a slight delamination or wear of the coating was noted after a total of 19,200 copies. With both types of receiver sheets the fused toner images had a 20° gloss of 98. The test was stopped at 20,000 copies when an approximately ⅛ inch ring of pitted area, which appeared to be caused by a mechanical problem or a defect in the coating, developed on the belt.

Comparative Example 1

A belt was prepared substantially as in Examples 1 and 2 except that the silsesquioxane sol-gel surface coating contained 0.5 weight percent of a fluorosilane compound of the formula $CF_3\ (CF_2)_5\ —CH_2CH_2SiCl_2—CH_3$ instead of a polyethylene oxide-polydimethylsiloxane surfactant such as DC 190 surfactant. The belt was tested in the fusing of Ricoh NC5006 toner to laser print paper. Toner offset occurred, and the paper did not release satisfactorily from the belt. The unsatisfactory test was stopped after 2,800 copies.

Comparative Example 2

A belt was prepared substantially as in Examples 1 and 2, except that the coating of crosslinked Acheson RC369 silicone polymer contained no surfactant. The belt had some evident defects caused by non-wetting of the poly-imide substrate by the silicone coating. When tested as a toner fusing belt, wear of the coating began to show after about 1,000 copies. The test was stopped at 2,700 copies because of large areas of wear.

Comparative Example 3

A belt was prepared as described in Examples 1 and 2, except that the priming layer comprising the cured Acheson RC 369 silicone polymer was omitted. The resulting belt was tested without a release oil in the fusing of Ricoh NC 5006 toner on "Vintage Velvet" clay-coated paper and a laser print paper, as described in Example 3. With the clay-coated paper, substantial toner offset was observed after about 1,000 copies. With the laser print paper, serious offset occurred even earlier, after about 400 copies. These results contrast with the performance of the belt described in Examples 2 and 3, which included the Acheson RC 369 under layer.

The invention has been described in detail with reference to certain preferred embodiments thereof, but it should be appreciated that variations and modifications can be effected within the scope of the invention.

We claim:

1. A toner fusing belt that comprises: a seamless polyimide substrate belt; a cross-linked silicone resin intermediate layer formed on said polyimide substrate by curing a composition comprising siloxanes having a ratio of difunctional to trifunctional units of 1:1 to 1:2.7, at least 90% of the total number of functional units of said siloxanes being difunctional and trifunctional units, the cross-linked silicone resin having a weight-average molecular weight of 5,000 to 50,000 and an alkyl to aryl ratio of 1:0.1 to 1:1.2; and, coated on said intermediate layer, a surface layer that comprises a silsesquioxane polymer.

2. A toner fusing belt according to claim 1 wherein said silsesquioxane polymer is of the formula:

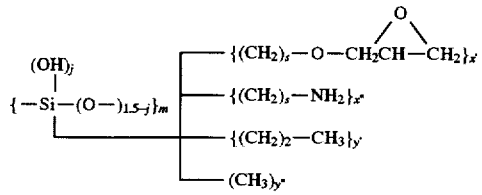

j is from 0 to about 0.5, m is greater than 10;

x' is from about 5 to about 30 mol%;

x" is from about 2 to about 10 mol%;

y' is from about 40 to about 90 mol%; and y" is from 0 to about 55 mol%.

3. A toner fusing belt according to claim 2 wherein said silicone resin intermediate layer contains about 2 to 4 weight percent of a surfactant-plasticizer.

4. A toner fusing belt according to claim 3 wherein said surfactant-plasticizer of the intermediate layer is a polyethylene oxide-polydimethyl siloxane copolymer.

5. A toner fusing belt according to claim 4 wherein said silsesquioxane surface layer contains 0.1 to 2 weight percent of a surfactant.

6. A toner fusing belt according to claim 5 wherein said surfactant is a polyalkylene oxide-modified polydimethylsiloxane.

7. A toner fusing belt according to claim 1 wherein said surface layer further comprises a filler selected from the group consisting of silica, alumina, cupric oxide, and stannic oxide.

8. A toner fusing belt according to claim 7 wherein said filler is silica.

9. A toner fusing belt according to claim 8 wherein said surface layer contains up to about 7 weight percent silica.

10. A method of forming a fused thermoplastic toner image on a receiver sheet that comprises:

passing said receiver sheet bearing unfused toner through the nip of a belt fuser apparatus in contact with the surface layer of a moving fusing belt, said belt comprising a seamless polyimide substrate, a highly crosslinked silicone resin intermediate layer on said substrate, and a silsesquioxane surface layer on said intermediate layer; and fusing said toner on the receiver sheet to form a toner image, cooling said belt and separating the receiver sheet from the moving and cooled belt, to obtain a sheet bearing a fused toner image having a 20° gloss of at least 90.

11. A method according to claim 10 wherein said toner is fused and said receiver sheet bearing a fused toner image is separated from the fusing belt without the use of a release oil.

* * * * *